US007703891B2

(12) United States Patent
Shim et al.

(10) Patent No.: US 7,703,891 B2
(45) Date of Patent: Apr. 27, 2010

(54) HEATER TO CONTROL BUBBLE AND INKJET PRINTHEAD HAVING THE HEATER

(75) Inventors: Dong-sik Shim, Suwon-si (KR); Hyung Choi, Seongnam-si (KR); Min-soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 852 days.

(21) Appl. No.: 11/471,490

(22) Filed: Jun. 21, 2006

(65) Prior Publication Data

US 2007/0126800 A1 Jun. 7, 2007

(30) Foreign Application Priority Data

Dec. 7, 2005 (KR) ..... 10-2005-0118671

(51) Int. Cl.
*B41J 2/05* (2006.01)

(52) U.S. Cl. ..... 347/62

(58) Field of Classification Search ..... 347/61–63
See application file for complete search history.

(56) References Cited

U.S. PATENT DOCUMENTS 4,339,762 A * 7/1982 Shirato et al. ..... 347/62
6,336,713 B1 * 1/2002 Regan et al. ..... 347/62
6,485,128 B1 * 11/2002 Elshaik et al. ..... 347/62

OTHER PUBLICATIONS

Korean Office Action dated Nov. 9, 2006 issued in KR 2005-118671.

* cited by examiner

*Primary Examiner*—Matthew Luu
*Assistant Examiner*—Lisa M Solomon
(74) *Attorney, Agent, or Firm*—Stanzione & Kim, LLP

(57) ABSTRACT

A heater to control an ink bubble, and an inkjet printhead having the heater. The heater has different resistances according to portions thereof.

9 Claims, 6 Drawing Sheets

HEATER TO CONTROL BUBBLE AND INKJET PRINTHEAD HAVING THE HEATER

CROSS-REFERENCE TO RELATED APPLICATIONS

This application claims the benefit of Korean Patent Application No. 10-2005-0118671, filed on Dec. 7, 2005, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a heater which can control a shape of a bubble generated in an inkjet printhead to enhance capability of ink ejection, and an inkjet printhead including the heater.

2. Description of the Related Art

An inkjet printhead is an apparatus that ejects minute ink droplets on desired positions of recording paper in order to print predetermined color images. Inkjet printers are classified into a shuttle type inkjet printer having a printhead being shuttled in a direction perpendicular to a transporting direction of a print medium to print an image, and a line printing type inkjet printer having a page-wide array printhead corresponding to a width of the print medium. The line printing inkjet printer has been developed for realizing high-speed printing. The array printhead has a plurality of inkjet printheads arranged in a predetermined configuration. In the line printing type inkjet printer, the array printhead is fixed while the print medium is transported during printing, thereby enabling the high-speed printing.

Inkjet printheads are categorized into two types according to an ink droplet ejection mechanism thereof. The first one is a thermal inkjet printhead that ejects ink droplets due to an expansion force of ink bubbles generated by thermal energy. The other one is a piezoelectric inkjet printhead that ejects ink droplets by a pressure applied to ink due to deformation of a piezoelectric body.

The ink droplet ejection mechanism of the thermal inkjet printhead is as follows. When a current flows through a heater made of a heating resistor, the heater is heated and ink near the heater in an ink chamber is instantaneously heated up to about 300° C. Accordingly, ink bubbles are generated by ink evaporation, and the generated bubbles are expanded to exert a pressure on the ink filled in the ink chamber. Thereafter, an ink droplet is ejected through a nozzle out of the ink chamber.

FIG. 1 is a cross sectional view illustrating a conventional thermal inkjet printhead. Referring to FIG. 1, the conventional inkjet printhead includes a substrate 10 on which a plurality of material layers are formed, a chamber layer 20 stacked on the substrate 10, and a nozzle layer 30 stacked on the chamber layer 20. An ink chamber 22 filled with ink to be ejected is formed in the chamber layer 20 and a nozzle 32 through which ink is ejected is formed in the nozzle layer 30. In addition, the substrate 10 has an ink feed hole 11 to supply ink to the ink chamber 22.

A typical silicon substrate is used as the substrate 10. An insulating layer 12 for insulation between a heater 13 and the substrate 10 is formed on the substrate 10. The insulating layer 12 is typically made of silicon oxide. The heater 13 is formed on the insulating layer 12 to heat the ink of the ink chamber 22 and generate a bubble. An electrode 14 is formed on the heater 13 to apply current to the heater 13.

A passivation layer 15 is formed on the heater 13 and the electrode 14 to protect the heater 13 and the electrode 14. The passivation layer 15 is typically made of silicon oxide or silicon nitride. An anti-cavitation layer 16 is formed on the passivation layer 15. The anti-cavitation layer 16 protects the heater 13 from a cavitation force generated when the bubbles vanish and is typically made of tantalum (Ta).

In the conventional inkjet printhead, the heater has a constant resistance in each portion and thus the amount of the heat generated in each portion of the heater 16 is the same. Accordingly, the conventional inkjet printhead including the heater 13 cannot control a shape of the bubble generated by the heater 13. Thus it is difficult to improve the capability of the ink ejection. Moreover, the bubble generated by the heater 13 is expanded to an ink inlet through which ink is flown to the ink chamber 22, and thus a back flow of the ink in the ink chamber 22, that is, ink flowing back to the ink inlet, may occur.

SUMMARY OF THE INVENTION

The present general inventive concept provides a heater to control a shape of a bubble to enhance capability of ink ejection, and an inkjet printhead including the heater.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept may be achieved by providing a heater usable in an inkjet printhead, the heater to heat ink in an ink chamber to eject the ink through a nozzle, the heater including portions having different resistances.

The portion of the heater under the nozzle may have the resistance of a maximum value, and the portion of the heater corresponding to an ink inlet through which ink is flown to the ink chamber may have the resistance of a value smaller than the maximum value.

The heater may have a plurality of through holes or protrusions formed in the heater in a predetermined arrangement such that the portions of the heater have different resistances.

The protrusions may be made of a material that has higher electric conductivity than a material of the heater.

The foregoing and/or other aspects and advantages of the present general inventive concept may also be achieved by providing an inkjet printhead comprising a substrate, a heater that is formed on the substrate and has different resistances according to portions thereof, an electrode that is formed on the heater to apply a current to the heater, a chamber layer that is stacked on the substrate on which the heater and the electrode are formed and includes an ink chamber filled with ink to be ejected and an ink inlet through which the ink is flown to the ink chamber, and a nozzle layer stacked on the chamber layer and formed with a nozzle through which ink is ejected.

The foregoing and/or other aspects and advantages of the present general inventive concept may also be achieved by providing an inkjet printhead comprising a substrate, a heater formed on the substrate, and having a plurality of portions different in at least one of shape and material, an electrode formed to apply a current to the heater, a chamber layer stacked on the substrate on which the heater and the electrode are formed, and a nozzle layer stacked on the chamber layer to form an ink chamber and an ink inlet with the chamber layer, and formed with a nozzle through which ink is ejected from the ink chamber.

The foregoing and/or other aspects and advantages of the present general inventive concept may also be achieved by providing a method of forming an inkjet printhead, the method comprising forming a heater on a substrate, the heater having a plurality of portions different in at least one of shape and material, forming an electrode to apply a current to the heater, stacking a chamber layer on the substrate on which the heater and the electrode are formed, and stacking a nozzle layer on the chamber layer to form an ink chamber and an ink inlet with the chamber layer, and formed with a nozzle through which ink is ejected from the ink chamber.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
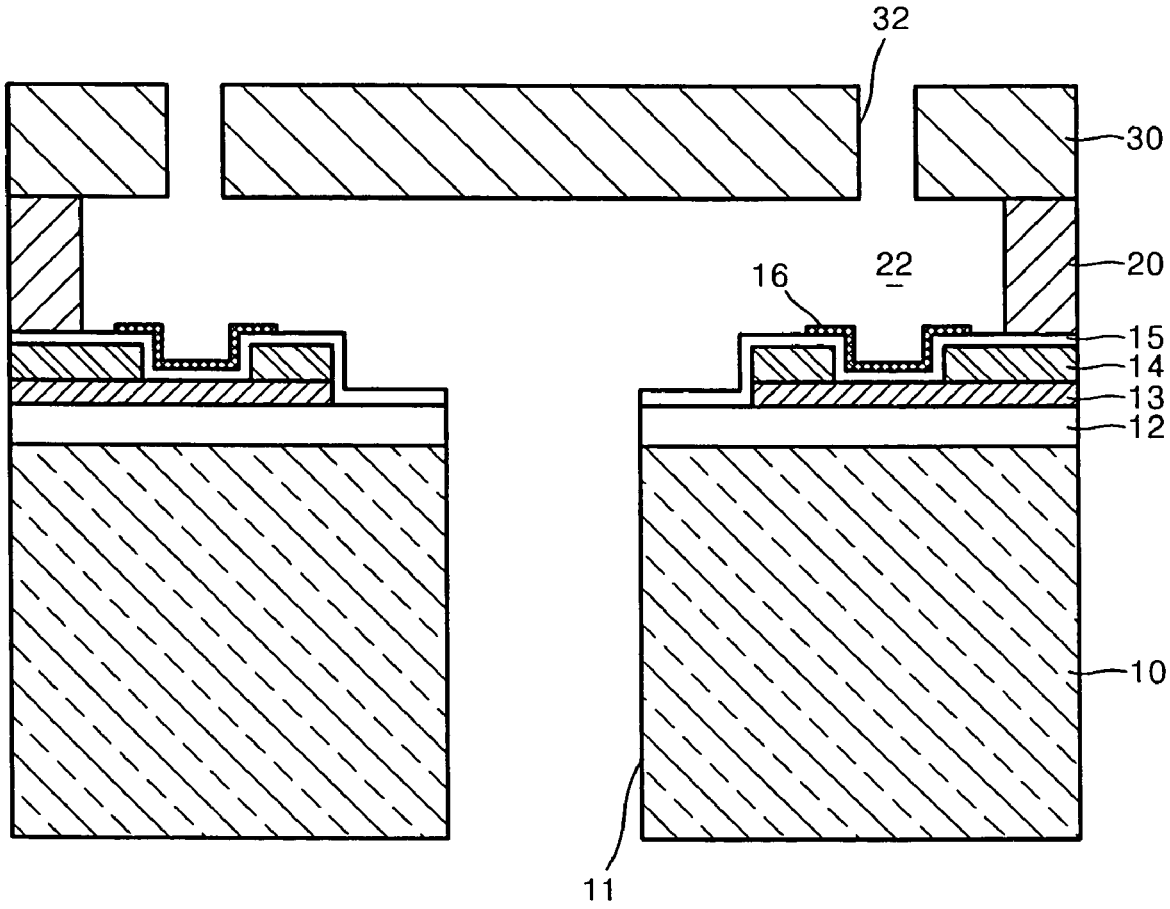
FIG. 1 (PRIOR ART)
FIG. 1 is a cross sectional view illustrating a conventional inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
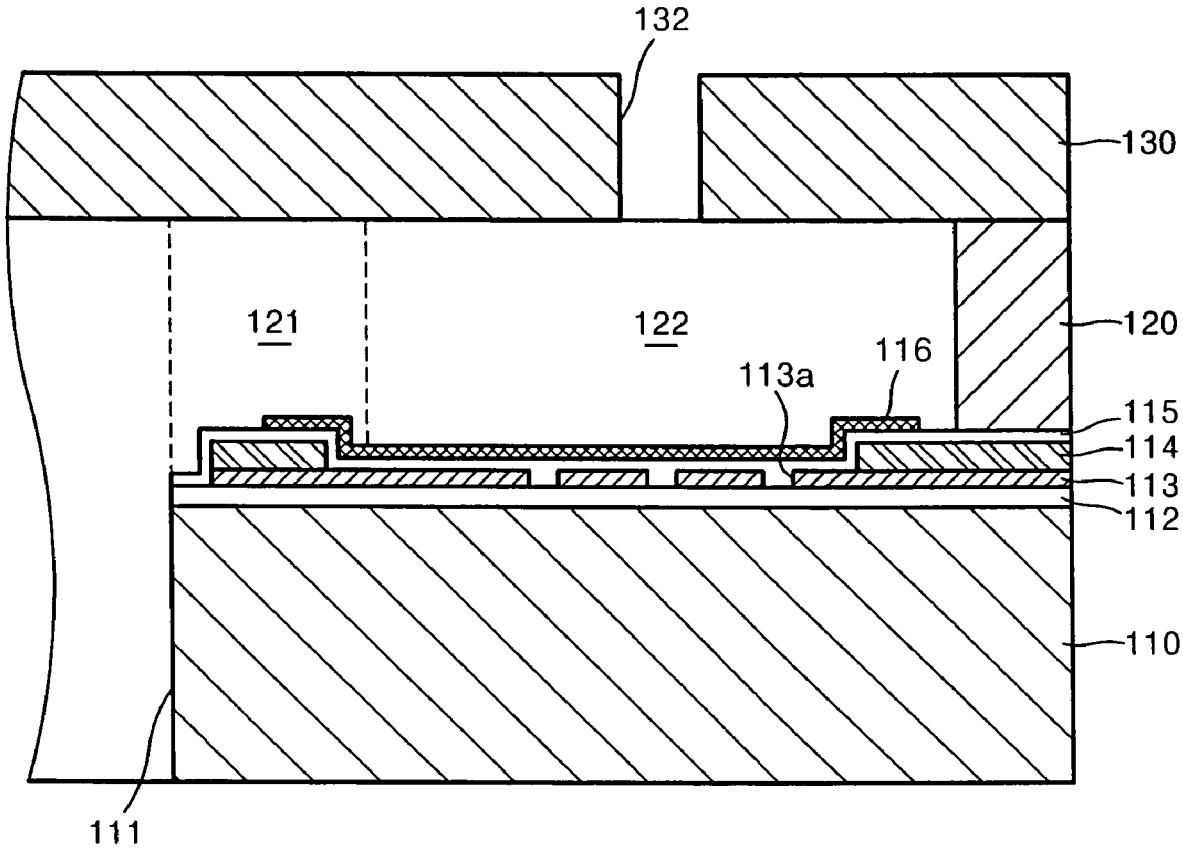
FIG. 2 is a cross-sectional view illustrating an inkjet printhead according to an embodiment of the present general inventive concept.

FIG. 2 is a cross-sectional view of an inkjet printhead according to an embodiment of the present general inventive concept. Referring to FIG. 2, the inkjet printhead includes a substrate 110, a chamber layer 120 stacked on the substrate 110, and a nozzle layer 130 stacked on the chamber layer 120. The substrate 110 includes an ink feed hole 111 to supply ink. The chamber layer 120 includes an ink chamber 122 supplied with the ink from the ink feed hole 111 and filled with the supplied ink to be ejected and an ink inlet 121 to receive the ink from the ink feed hole 111 and to supply the received ink to the ink chamber 122. The nozzle layer 130 includes a nozzle 132 through which the ink is ejected from the ink chamber 122.

The substrate 110 may be typically a silicon substrate. An insulating layer 112 may be formed on the substrate 110 for insulation between a heater 113 and the substrate 110. The insulating layer 112 may be typically made of silicon oxide. The heater 113 is formed on the insulating layer 112 to heat the ink in the chamber 122 and generate ink bubbles and an electrode 114 is formed on the heater 113 to apply a current to the heater 113.

A passivation layer 115 may be formed on the insulating layer 112 to cover the heater 113 and the electrode 114. The passivation layer 115 protects the heater 113 and the electrode 114 from oxidization or corrosion if the heater 113 and the electrode 114 contact the ink and may be typically made of silicon oxide or silicon nitride. An anti-cavitation layer 116 is formed on a top surface of the passivation layer 115 that forms a bottom of the ink chamber 122. The anti-cavitation layer 116 may be made of tantalum (Ta) and protects the heater 113 from a cavitation force when the ink bubbles vanish.

The heater 113 may have one or more portions having different resistances. The heater 113 may have a configuration to have the different resistances along a direction in which the ink flows in the ink chamber 122. One or more holes 113*a* are formed on the heater to correspond to the respective portions to have the different resistances in the ink flow direction from the ink inlet 121 to the nozzle 132 or from one of the portions of the heater 113 to the other one of the portions of the heater 113. The one or more holes 113*a* may be through holes. Accordingly, the ink bubbles can be generated in a desired position in the ink chamber 122 and thus a shape and size of the ink bubbles can be controlled, thereby improving capability of the ink ejection. For example, the heater 113 may have a maximum resistance in a position corresponding to the nozzle 132, that is, under the nozzle 132 and one or more resistances which may be smaller than the maximum resistance in another position corresponding to the ink inlet 121, that is, near the ink inlet 121.

Figure 3:
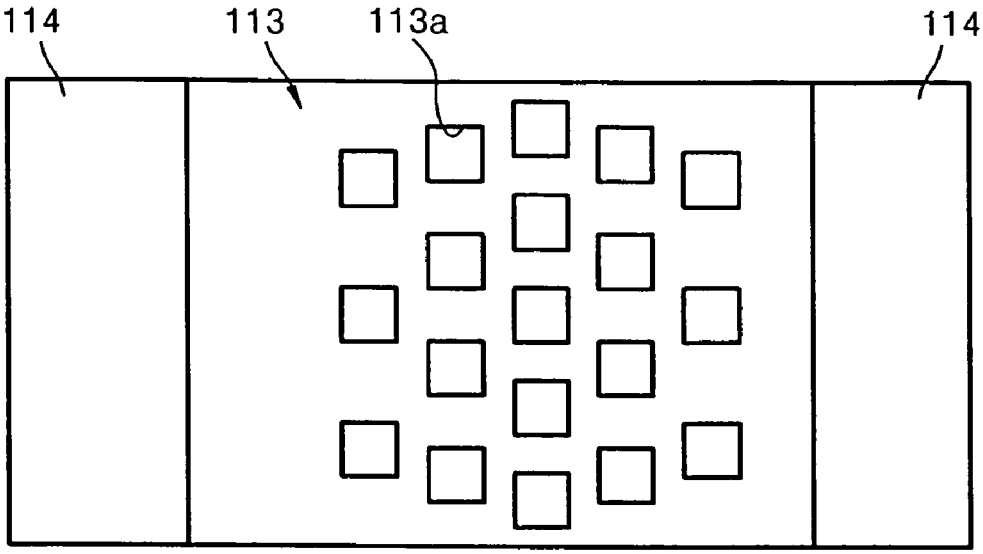
FIG. 3 is a plan view illustrating a heater of the inkjet printhead of FIG. 2.
Figure 4A:
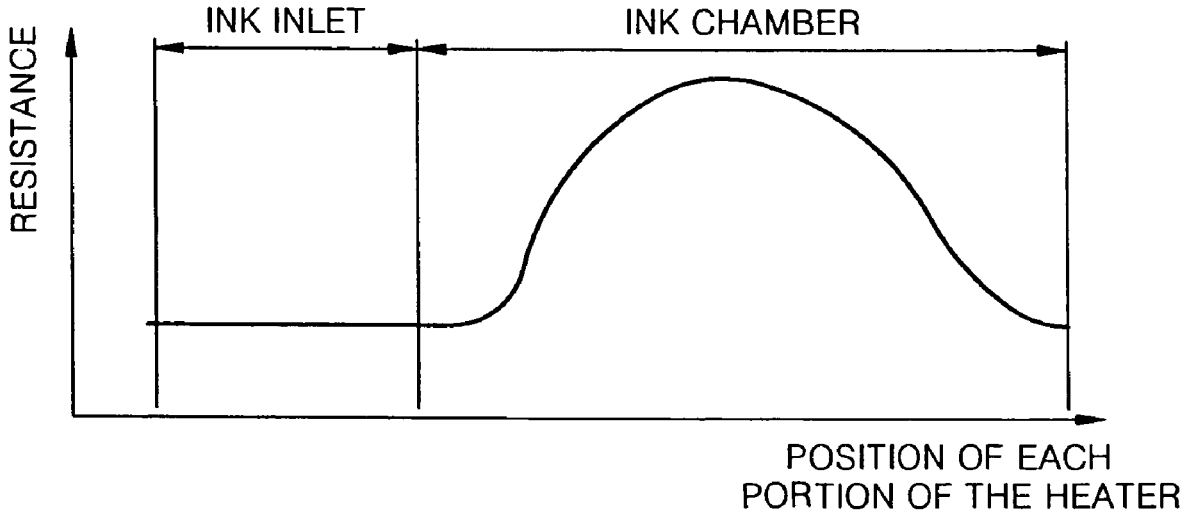
FIGS. 4A and 4B are graphs illustrating resistance and an amount of heat according to portions in the heater of FIG. 3, respectively.
Figure 4B:
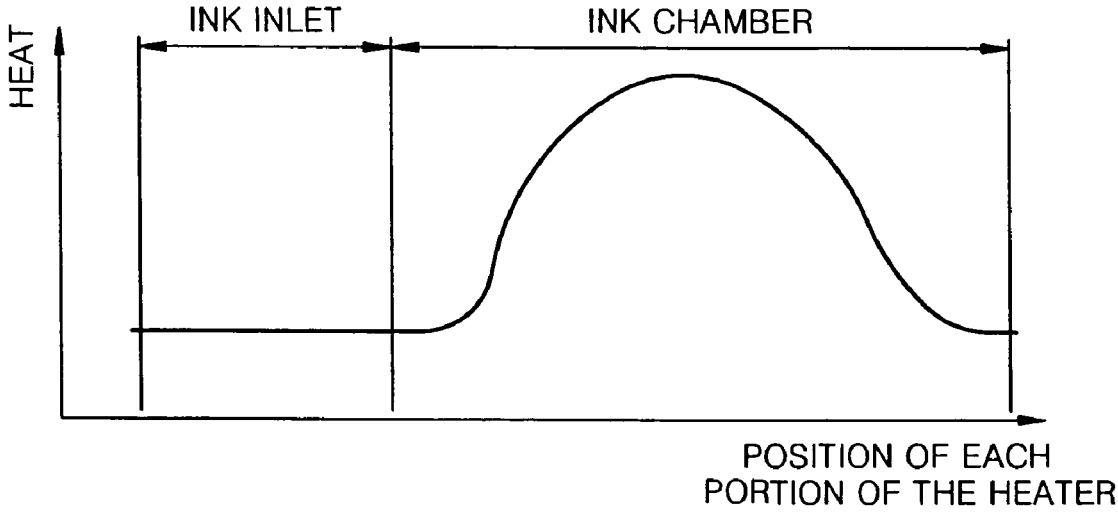

FIG. 3 is a plan view illustrating the heater 113 of the inkjet printhead of FIG. 2. FIGS. 4A and 4B illustrate the resistance and the amount of the heat generated in each portion of the heater 113 of FIG. 3.

Referring to FIGS. 2 and 3, the plurality of through holes 113*a* are formed in the heater 113 to be arranged in a predetermined pattern. The through holes may have a first number of through holes 113*a* formed in the heater 113 under the nozzle 132 and a second number of through holes 113*a* formed in the heater 113 near the ink inlet 121. The first number of through holes 113*a* is greater than the second number of through holes 113*a*. It is possible that the number of through holes 113*a* may decrease according to a distance from the portion of the heater 113 corresponding to the nozzle 132. Accordingly, as illustrated in FIG. 4A, the resistance of the heater 113 is maximum in an area where the first number of through holes 113*a* are formed, that is, under the nozzle 132, and becomes smaller near the ink inlet 121. When the portions having different resistances are electrically connected, the amount of the heat generated in each portion is in proportion with the resistance of the portion. Accordingly, as illustrate in FIG. 4B, the amount of heat generated in the portion of the heater 113 under the nozzle 132 is greater than the portion of the heater 113 near the ink inlet 121. Although FIG. 3 illustrates a square shape of the through holes 113*a*, the shape of the through holes 113*a* is not limited thereto.

The heater 113 may be formed by depositing a heating resistor, such as Ta—Al alloy, TaN, TiN, or tungsten silicide, on a top surface of the insulating layer 112 and patterning the heating resistor to a predetermined shape. The electrode 114 may be formed by depositing a metal having good electric conductivity such as Al, Al alloy, Au, and Ag, and patterning the metal to a predetermined shape. The plurality of through holes 113*a* can be filled with a material which may be the same as the passivation layer 115 or different from the heating resistor of the heater 113.

As described above, the heater 113 may partially have different resistances according to portions in the inkjet printhead. That is, the resistance of the heater 113 has a maximum value under the nozzle 132 and different values smaller than the maximum value near the ink inlet 121. Accordingly, the amount of heat generated in the heater 113 under the nozzle 132 of the heater 113 is greater than the heat generated in the heater 113 near the ink inlet 121. It is possible that the resistance of the portion of the heater 113 around the nozzle 132 has a value greater that around the ink inlet 121. Accordingly, the amount of heat generated in the portion of the heater 113 around the nozzle 132 is greater than the heat generated in the portion of the heater 113 around the ink inlet 121. As a result, the ink bubbles are generated and expanded under the nozzle 132 to eject the ink. Accordingly, a back flow of the ink in the ink chamber 122, that is, ink flowing back to the ink inlet 121, is reduced. In the present embodiment, the through holes 113*a* have the same size. However, the sizes of the through holes 113*a* can vary in order to control the resistances of the heater 113 according to portions thereof.

Figure 5:
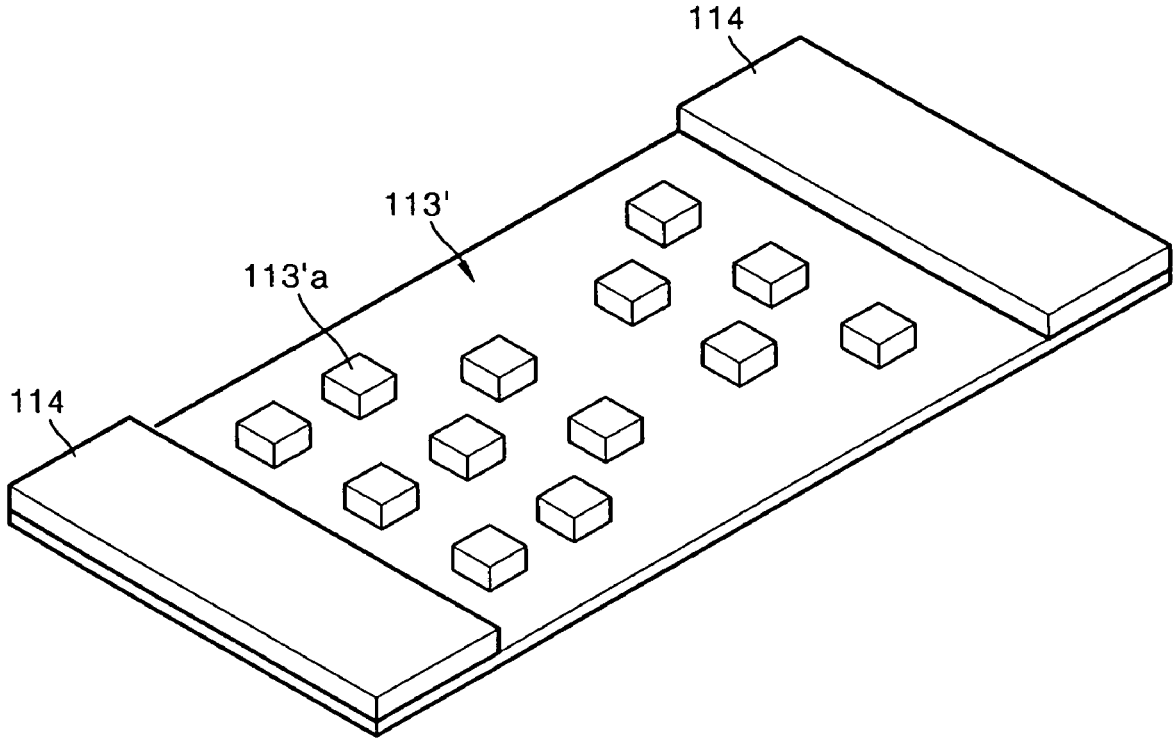
FIG. 5 is a perspective view illustrating a heater of usable in an inkjet printhead according to an embodiment of the present general inventive concept.

FIG. 5 is a perspective view illustrating a heater 113' which can be used in an inkjet printhead according to an embodiment of the present general inventive concept. Referring to FIG. 5, a plurality of protrusions 113'*a* are formed between electrodes 114 on a top surface of the heater 113 to be arranged in a predetermined pattern. The number of the plurality of protrusions 113'*a* formed on the heater 113' under the nozzle 132 is smaller than the number of the protrusions 113'*a* formed on the heater 113 near the ink inlet 121. The protrusions 113'*a* may be made of a material having higher electric conductivity than that of the heater 113'. The protrusions 113'*a* may be formed of a material having good electric conductivity like Al, Al alloy, Au, and Ag. The material of the protrusions may be the same as the electrode 114. The protrusions may be formed simultaneously with the electrode 114. In this case, the resistance of the heater 113' is maximum under the nozzle 132 in the area of the heater 113' where least protrusions 113'*a* formed of good electric conductive materials are formed, that is, under the nozzle 132, and the resistance of the heater 113' is minimum in the area where most of the protrusions 113'*a* are formed, that is, near the ink inlet 121. Accordingly, most of the heat is generated in the heater 113' under the nozzle 132 and the least amount of heat is generated in the heater 113' near the ink inlet 121. In FIG. 5, the protrusions 113'*a* have a square shape, but the protrusions 113'*a* may have other shapes. In addition, although the protrusions 113'*a* have an identical size to control the resistances of the heater 113' according to portions thereof, the size of the protrusions 113'*a* may be different to control the resistances of the heater 113' according to portions.

Figure 6A:
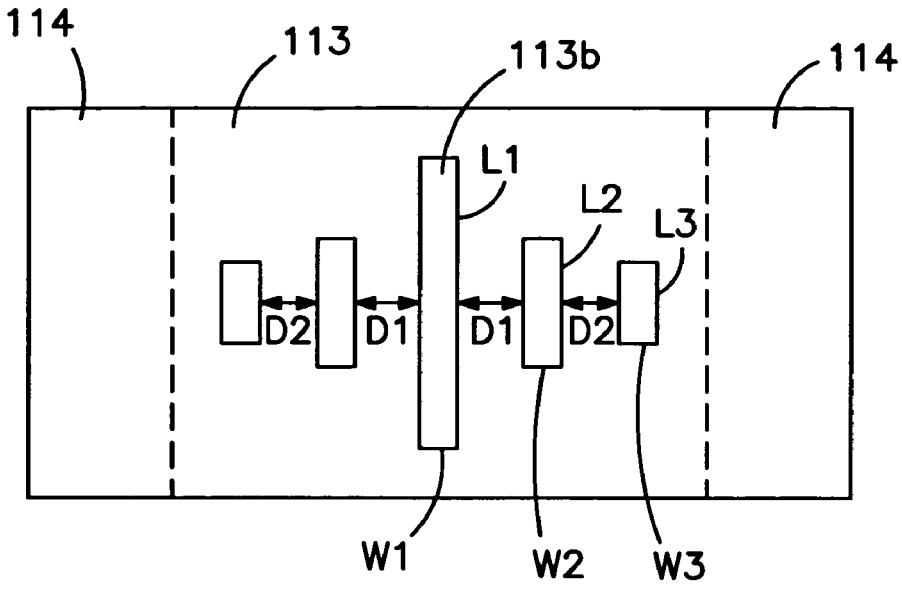
FIGS. 6A, 6B, 7A, and 7B are plan views illustrating a heater of an ink printhead according to an embodiment of the present general inventive concept.
Figure 6B:
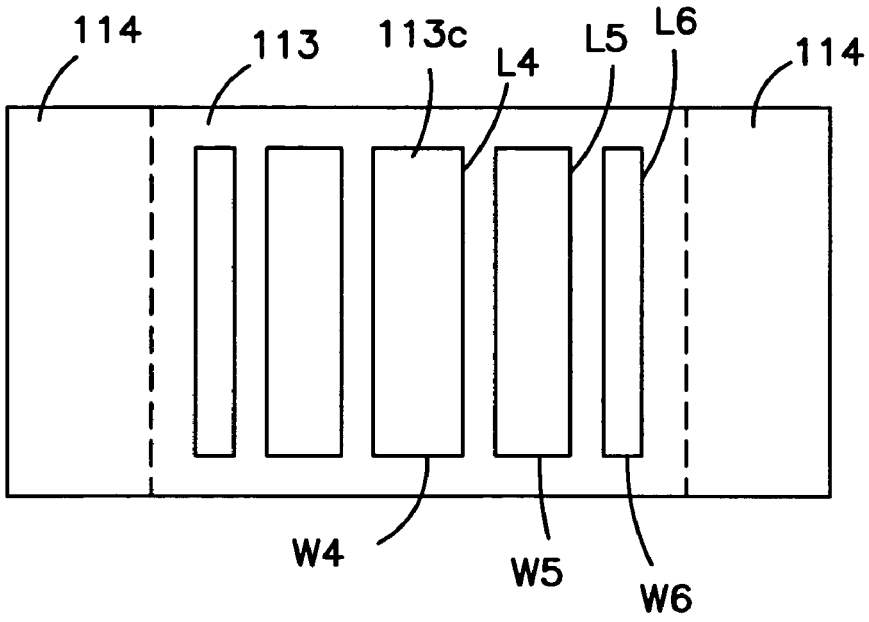

FIGS. 6A, 6B, 7A and 7B are plan views illustrating a heater 113 of an ink printhead according to an embodiment of the present general inventive concept. Referring to FIG. 6A, a plurality of grooves (or longitudinal holes) 113*b* are formed in the heater 113 between electrodes 114. The holes 113*b* are arranged in a direction between the electrodes 114 or in a direction of a current flowing through the heater 113 between the electrodes 114. The holes 113*b* may have lengths L1, L2, and L3 in a direction having an angle with the direction, widths W1, W2, and W3 in the direction, and distances D1 and D2 between the holes 113*b* in the direction. The lengths L1, L2, and L3 may be different, the widths W1, W2, and W3 may be the same, and the distances D1 and D2 may be the same, Referring to FIGS. 6A and 6B, a plurality of grooves (or longitudinal holes) 113*c* may have lengths L4, L5, and L6 which are the same, and widths W4, W5, and W6 which are different. The grooves 113*b* and 113*c* may have a cross-sectional area different from non groove areas between the grooves 113*b* and 113*c*, respectively. Each surface of the grooves 113*b* and 113*c* may be filled with a material which is the same as the passivation layer 115 of FIG. 3 to compensate for a difference between the cross-sectional areas.

Figure 7A:
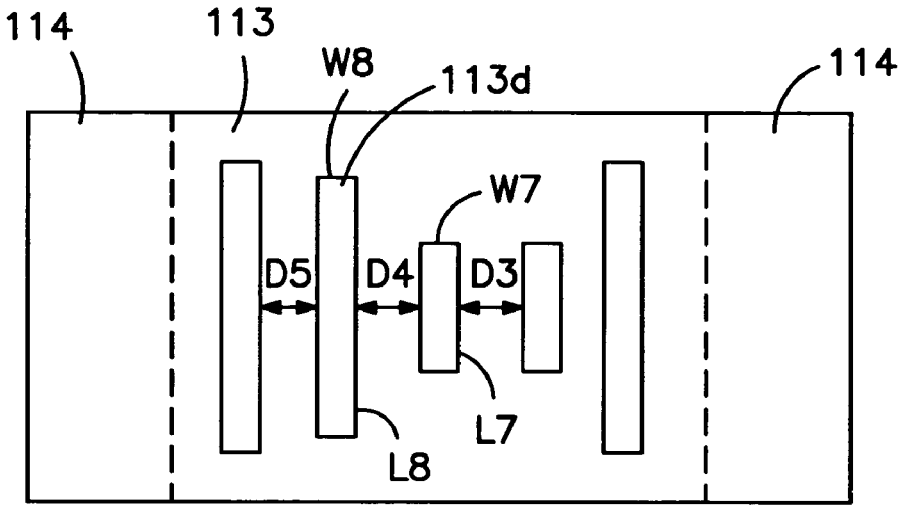
Figure 7B:
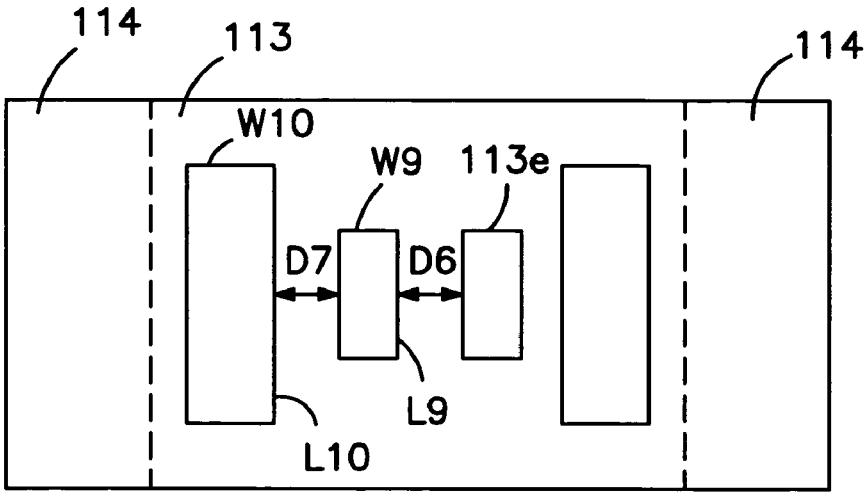

Referring to FIG. 7A, a plurality of protrusions 113*d* are formed on a heater 113 between electrodes 114. The protrusions 113*d* are arranged in a direction between the electrodes 114 or in a direction of a current flowing through the heater 113 between the electrodes 114. The protrusions 113*d* may have lengths L7 and L8 in a direction having an angle with the direction, widths W7 and W8 in the direction, and distances D3, D4, and D5 between the holes 113*d* in the direction. The lengths L7 and L8 may be different, the widths W7 and W8 may be the same, and the distances D3, D4, and D5 may be the same, Referring to FIGS. 7A and 7B, a plurality of grooves (or longitudinal holes) 113*c* may have lengths L9 and L10, widths W9 and W10, and distances D6 and D7. The lengths L9 and L10 may be different, the widths W9 and W10 may be different, and the distances D6 and D7 may be different. However, shapes of the holes 113*b* and 113*c* and the protrusions 113*d* and 114*e* are not limited thereto. The passivation layer 115 of FIG. 3 may be formed on the protrusions 113*d* or 113*e* and non-protrusion areas between the protrusions 113*d* or 113*e*. Accordingly, the passivation layer 115 may have a cross-sectional area different from the non-protrusion areas to compensate for a difference between the cross-sectional areas.

As described above, the heater has different resistances according to portions thereof in order to generate ink bubbles in a desired position and thus control the shape and size of the bubbles, thereby improving the capability of the ink ejection. Also, the back flow of the ink of the ink chamber, that is, ink flowing back to the ink inlet, can be reduced without changing the structure of the ink chamber.

The general inventive concept may, however, be embodied in many different forms and should not be construed as being limited to the embodiments set forth herein; rather, these embodiments are provided so that this disclosure will be thorough and complete, and will fully convey the concept of the invention to those skilled in the art. For example, it will also be understood that when a layer is referred to as being "on" another layer or a substrate, it can be directly on the other layer or the substrate, or intervening layers may also be present. The components of the inkjet printhead according to the present general inventive concept may be made of different materials from the current embodiments.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead comprising:

a substrate;

a heater that is formed on the substrate and has a plurality of portions having different resistances;

an electrode that is formed on the heater and applies a current to the heater;

a chamber layer that is stacked on the substrate on which the heater and the electrode are formed and includes an ink chamber filled with ink to be ejected and an ink inlet through which the ink is flown to the ink chamber; and a nozzle layer stacked on the chamber layer and formed with a nozzle through which ink is ejected, wherein the portions comprise a first portion disposed under the nozzle to have the resistance of a maximum value and a second portion disposed near the ink inlet to have the resistance smaller than the maximum value.

2. The inkjet printhead of claim 1, wherein the portions comprise a plurality of through holes formed therein in a predetermined arrangement such that the heater has the different resistances according to locations of the portions.

3. The inkjet printhead of claim 1, wherein the portions comprise a plurality of grooves formed therein in a predetermined arrangement such that the heater has the different resistances according to locations of the portions.

4. The inkjet printhead of claim 1, wherein the portions comprise a plurality of protrusions formed thereon in a predetermined arrangement such that the heater has the different resistances according to location of the portions.

5. The inkjet printhead of claim 4, wherein the protrusions are made of a material that has a higher electric conductivity than a material of the heater.

6. The inkjet printhead of claim 5, wherein the protrusions are formed of the same material as that of the electrode.

7. The inkjet printhead of claim 1, further comprising:

an insulating layer formed between the substrate and the heater.

8. The inkjet printhead of claim 1, further comprising:

a passivation layer formed on the substrate on which the heater and the electrode are formed, in order to cover the heater and the electrode.

9. The inkjet printhead of claim 8, further comprising:

an anti-cavitation layer formed on a top surface of the passivation layer to form a bottom of the ink chamber.

* * * * *